United States Patent [19]

Rizzone et al.

[11] 4,221,549

[45] Sep. 9, 1980

[54] INERTIA BAR FOR SUCKER RODS

[75] Inventors: Michael L. Rizzone; Walter S. Secrist, both of Dallas, Tex.

[73] Assignee: United States Steel Corporation, Pittsburgh, Pa.

[21] Appl. No.: 731,596

[22] Filed: Oct. 12, 1976

Related U.S. Application Data

[63] Continuation-in-part of Ser. No. 665,845, Mar. 11, 1976, abandoned, which is a continuation of Ser. No. 216,401, Jan. 10, 1972, abandoned.

[51] Int. Cl.[3] ..... F04B 21/00

[52] U.S. Cl. ..... 417/437; 74/579 R; 74/590

[58] Field of Search ..... 417/211, 448, 449, 450, 417/437, 555 A; 92/128, 220, 258; 166/243; 74/61, 579 R, 590

[56] References Cited

U.S. PATENT DOCUMENTS

| | | | |
|---|---|---|---|
| 1,773,057 | 8/1930 | Morefield | 417/569 |
| 1,810,121 | 6/1931 | Black | 417/456 |
| 2,328,856 | 9/1943 | Stone | 138/140 X |
| 2,414,254 | 1/1947 | Busby | 166/106 |
| 2,594,617 | 4/1952 | Boice | 138/140 X |
| 2,808,231 | 10/1957 | Kimbrell | 285/55 |
| 3,047,313 | 7/1962 | Bruce | 285/333 X |
| 3,195,927 | 7/1965 | Kimbrell | 138/140 X |

*Primary Examiner*—Leonard E. Smith
*Attorney, Agent, or Firm*—Walter P. Wood

[57] ABSTRACT

An inertia bar to be installed in a well between a sucker rod string and a subsurface pump. A string of the bars adds weight to the sucker rod string and maintains it under tension throughout a pumping cycle. A sufficient number of the bars are used to place a neutral zone within the inertia bars. The neutral zone is a zone in which there is neither tension nor compression in the bars. The body of each bar has a relatively large diameter, which for example may be the same as the outside diameter of the couplings used to connect the individual sucker rods. The bar has pins at its ends for engaging the couplings, which pins have the same dimension as standard sucker rod pins. The bar can be engaged by a conventional elevator when it is to be removed from a well.

2 Claims, 4 Drawing Figures

INERTIA BAR FOR SUCKER RODS

This application is a continuation-in-part of our earlier application Ser. No. 665,845, filed Mar. 11, 1976, now abandoned which in turn is a continuation of our earlier application Ser. No. 216,401 filed Jan. 10, 1972, now abandoned.

This invention relates to an improved inertia bar for use in sucker rod string.

In the oilwell art, sucker rods are rods which extend down a well to a subsurface pump and are driven up and down to operate the pump. When a string of sucker rods is immersed in a well, there is a hydraulic up-force acting on the cross-sectional area of the rod, which force is equivalent to the hydraulic pressure at the bottom of the well. This force is a function of the depth of the well and can be substantial. For example, at a depth of 5000 feet in salt water with a specific gravity of 1.1, the up-force on a ¾ inch diameter sucker rod is about 1060 pounds. This force tends to buckle the sucker rod string during their downstrokes and may induce fatigue failure.

As a means for overcoming the up-force on a sucker rod string, it is known to insert weights in the bottom of the string to serve as inertia bars just above the pump. The weights are intended to be of a magnitude to maintain the sucker rods under tension throughout the pumping cycle. Weights used heretofore have been old polished rods, a term which refers to the rod at the top of the sucker rods connected to the driving unit. Polished rods, not being designed for this purpose, are awkward to handle and are hit-or-miss as to where they locate the "neutral zone", that is, the level at which there is neither tension nor compression in the string.

The thread on the pin of a conventional polished rod is of the vanish type; that is, the thread fades out toward the body of the rod and there is no shoulder against which a coupling can be locked. The region at which the thread fades out becomes a stress notch where fatigue failure often occurs. As a consequence, when polished rods are used as weights at the bottom of a well, the pins are easily broken at the stress notches, or the couplings may become unscrewed accidentally since they are not positively locked against shoulders on the rods. As the number of polished rods is increased to add more weight, the tendency of the pins to break or of the couplings to become unscrewed becomes progressively worse. A conventional polished rod has no means for engagement by an elevator or a fishing tool. Hence when polished rods are used as weights, it is awkward to retrieve the pump from the well in normal operation, or to fish the loose parts from the well if a pin breaks or a coupling becomes unscrewed. Because of these problems, the number of polished rods used as weights has been limited to two or three. A rather long polished rod has a length of about 26 feet. The maximum length of weights attainable with polished rods is about 78 feet.

When a polished rod is used for its intended purpose at the top of a sucker rod string, the coupling at the top of the polished rod provides a shoulder which the hanger of a pumping unit may engage for supporting the rod string. Hence polished rods are of significantly smaller diameter than the outside diameter of the couplings and not of the full diameter which can be accommodated within the limits of the coupling diameter. Because of these limitations, it is exceedingly unlikely that the hit-or-miss location of the neutral zone would ever be within polished rods used as weights at the bottom of a well.

An object of our invention is to provide an improved inertia bar which is readily handled by conventional equipment used for handling sucker rods and which is accurately constructed for its intended purpose.

A further object is to provide an inertia bar which is dimensioned accurately to locate the neutral zone at a controlled level, typically about 80 percent of the distance up from the pump to the top of a string of such bars.

Figure 1:
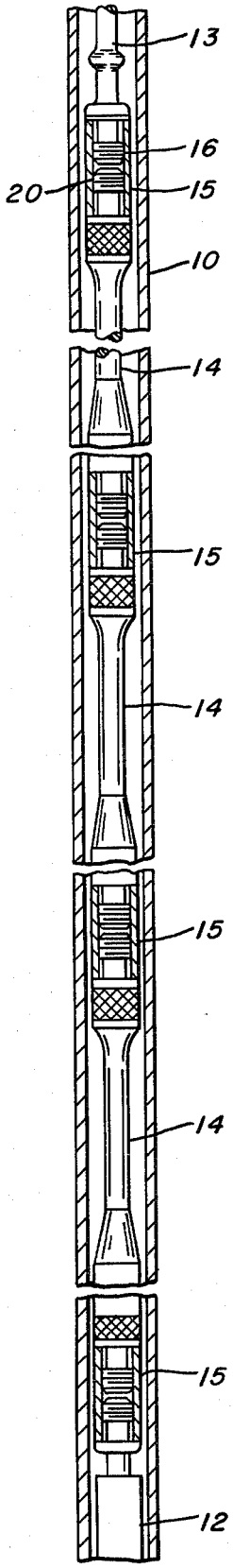
FIG. 1 is a diagrammatic vertical sectional view of the lower portion of a well in which a string of inertia bars constructed in accordance with our invention is installed between the sucker rods and the pump.

FIG. 1 shows the lower portion of a well tubing 10, a subsurface pump 12 within the tubing, and a sucker rod string 13, all of which can be of conventional construction, or the pump can be of special construction with which the invention has added utility, as hereinafter explained. The sucker rod string extends to the surface where it is reciprocated up and down through any suitable drive mechanism, not shown. A string of inertia bars 14 constructed in accordance with our invention is joined between the lowermost sucker rod and the upper end of the reciprocating element of pump 12. Couplings 15, all of similar construction, join the individual sucker rods and inertia bars to one another, and to the pump. Preferably all couplings which are connected to the inertia bars are identical with those used in the sucker rod string. The ends of the sucker rods have standardized pins 16 with which the couplings are threadedly engaged.

Figure 2:
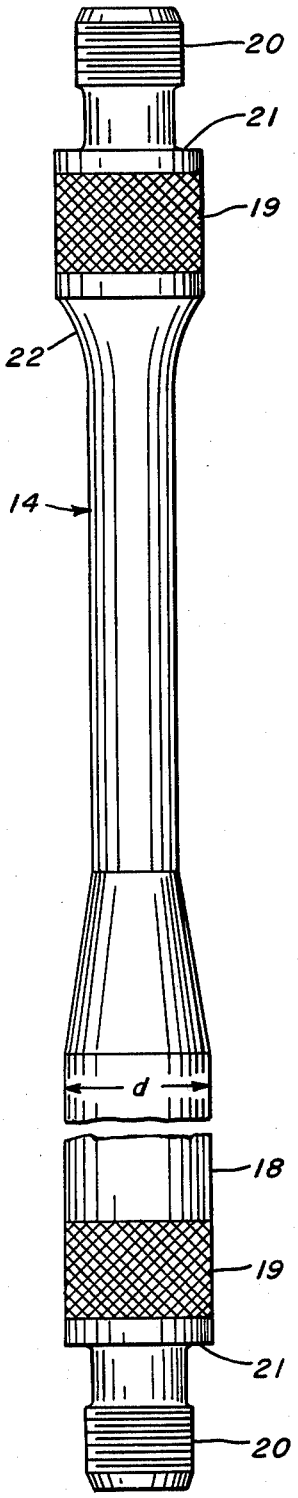
FIG. 2 is a side elevational view of one of our inertia bars.
Figure 3:
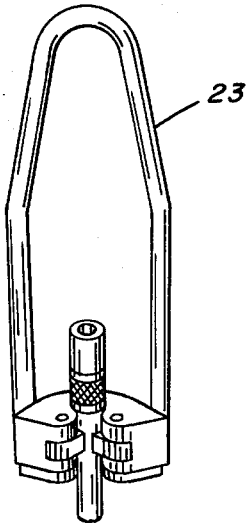
FIG. 3 is a perspective view illustrating the way in which our inertia bars can be handled with a conventional elevator for sucker rods.

As FIG. 2 shows, each inertia bar 14 includes an elongated metal body 18 of any desired length, but commonly in the range of about 15 to 50 feet. The diameter d of the major portion of the body preferably is substantially the same as the outside diameter of the couplings 15. In any event the body diameter is not significantly less than the outside diameter of the couplings, and may be greater if the tubing or casing is large enough to permit fluid to flow past the body. Near its upper and lower ends the body has means to be engaged by a wrench or equivalent. We have illustrated this means as knurled portions 19, but wrench flats are equivalent. The bar includes integral threaded pins 20 at opposite ends of the body. These pins are of the same length and diameter as the standard sucker rod pins 16. The body has a shoulder 21 where it meets the coupling 15 at each end, that is, at the base of each pin. We tighten the couplings into locking engagement with these shoulders to furnish positive joints. Near its upper end the body has a section 22 of reduced diameter shaped to be engaged by a conventional sucker rod elevator 23 when the rod string is pulled from the well, as FIG. 3 shows.

Figure 4:
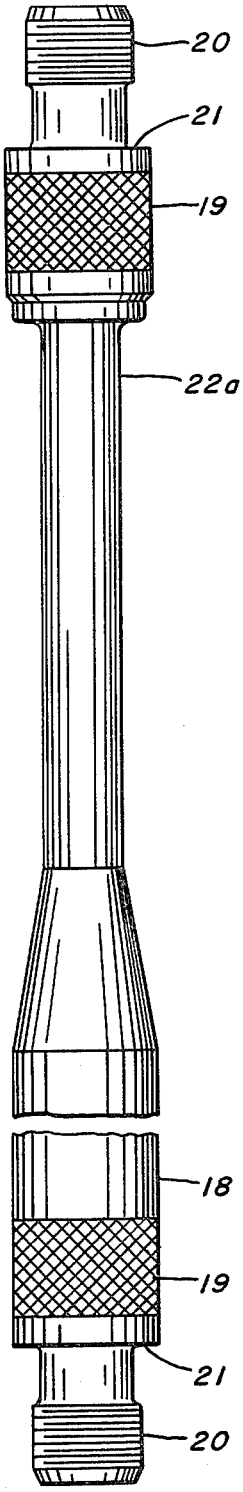
FIG. 4 is a side elevational view similar to FIG. 2 but showing a modified embodiment of our inertia bar.

FIG. 4 shows a modification in which the section **22*a*** of reduced diameter is shaped to be engaged by a tubing-type elevator (not shown). In other respects the modified inertia bar is similar to that already described, and we have not repeated the description.

In operation, we install a string of inertia bars 14 at the bottom of the string of sucker rods 13, as shown in FIG. 1. We use a predetermined number of inertia bars to maintain the entire string of sucker rods in tension throughout the pumping cycle and to locate the neutral zone about 80 percent of the distance up from pump 12 to the top of the string of inertia bars. The number of inertia bars required of course varies with the well depth and buoyant effect of the well fluid. The length of the string of inertia bars is at least 100 feet and may be over 1000 feet. We minimize the number by making the diameter of each bar as large as practicable. Since the pins 20 on the bars have the same dimensions as the sucker rod pins 16, no special couplings or adapters are needed, as when old polished rods are used as weights. Polished rods have larger pins than sucker rods, since they must sustain the full weight of the rod string.

The string of inertia bars acts as a linear flywheel actuated in reciprocating motion. Thus it is possible to obtain extra production from a well through the overtravel effect resulting from elasticity in the rod string. The overtravel effect is particularly significant in a gassy well, in which bubbles of gas may be released in the pump barrel. If the stroke of the pump plunger is limited to the stroke applied to the sucker rods at the surface, the plunger may be acting only to compress gas and release the pressure through a major portion of its strokes. Overtravel of the plunger affords additional stroke length which is effective to pump oil. Another benefit is the ability of the sucker rod string to perform more effectively in viscous or sand laden fluids, since there is less tendency for the pump to stick.

The inertia bar of the present invention has added utility when used in certain special type pumping operations, for example, in a downstroke pumping operation or with a pump in which the column of fluid in the well tubing does not assist in driving the plunger downwardly during a downstroke. The term "downstroke pumping" refers to any pumping operation in which fluid discharges from the pumping chamber into the tubing during a downstroke of the plunger; that is, fluid may discharge only on the downstroke or to some extent on both the upstroke and the downstroke. Such pumps place an excessive load on sucker rods on each downstroke. A heavy load of inertia bars is needed to assure that the neutral zone is located within the inertia bars during the downstroke. In pumps in which the column of fluid in the tubing does not assist in driving the plunger downwardly, a heavy load of inertia bars is useful for this purpose. The limitations on the use of old polished rods as weights hereinbefore described precludes their use for performing the foregoing functions. An unacceptable number of polished rods would be required to provide the necessary weight, both because of the greater likelihood of failure and their smaller weight per unit length.

We claim:

1. A combination comprising a string of sucker rods having threaded pins at their ends, couplings of like construction engaging said pins and joining the rods end-to-end, a subsurface pump, a string of inertia bars connected between the lowermost sucker rod and said pump for adding weight to the sucker rods and maintaining them in tension throughout a pumping cycle, and couplings of similar construction to said first-named couplings joining said inertia bars end-to-end;

each of said inertia bars comprising:

an elongated metal body of substantially the same diameter as the outside diameter of said couplings;

integral threaded pins at the respective ends of said body; and shoulders at the base of said pins having locking engagement with said second-named couplings;

said string of inertia bars having a neutral zone located about 80 percent of the distance up from the pump to the top of the string of inertia bars.

2. An inertia bar as defined in claim 1 in which said body has a length of about 15 to 50 feet.

* * * * *